US010539391B2

(12) United States Patent
Bridgman, Jr.

(10) Patent No.: US 10,539,391 B2
(45) Date of Patent: Jan. 21, 2020

(54) GUN GUARD

(71) Applicant: Lee H. Bridgman, Jr., North Pole, AK (US)

(72) Inventor: Lee H. Bridgman, Jr., North Pole, AK (US)

( * ) Notice: Subject to any disclaimer, the term of this patent is extended or adjusted under 35 U.S.C. 154(b) by 0 days.

(21) Appl. No.: 15/998,211

(22) Filed: Jul. 14, 2018

(65) Prior Publication Data

US 2018/0347946 A1 Dec. 6, 2018

Related U.S. Application Data

(63) Continuation of application No. 15/732,952, filed on Jan. 12, 2018, now abandoned.

(60) Provisional application No. 62/447,342, filed on Jan. 17, 2017.

(51) Int. Cl.

| | |
|---|---|
| ***F41A 35/02*** | (2006.01) |
| ***F41G 1/38*** | (2006.01) |
| ***F41C 33/06*** | (2006.01) |

(52) U.S. Cl.

CPC ..... *F41G 1/383* (2013.01); *F41A 35/02* (2013.01); *F41C 33/06* (2013.01)

(58) Field of Classification Search

CPC ..... F41A 35/02; F41A 21/44; F41C 33/06; F41C 33/002; F41C 33/0209; F41G 1/383

USPC ..... 42/83, 96

See application file for complete search history.

(56) References Cited

U.S. PATENT DOCUMENTS

| | | | | | |
|---|---|---|---|---|---|
| 35,456 | A * | 6/1862 | Leverich | F41A 35/02 | 42/96 |
| 2,364,340 | A * | 12/1944 | Bogg, Jr. | F41A 35/02 | 42/106 |
| 2,872,960 | A * | 2/1959 | Kolpin | F41C 33/06 | 206/317 |
| 2,932,334 | A * | 4/1960 | Steen | F41A 35/02 | 206/317 |
| 3,142,424 | A * | 7/1964 | Reed, Jr. | B62J 11/00 | 224/422 |
| 3,540,508 | A * | 11/1970 | Couch | F41C 33/06 | 206/317 |
| 4,369,904 | A * | 1/1983 | Christensen | F41C 33/06 | 206/315.11 |
| RE32,752 | E * | 9/1988 | Kiang | F41C 23/18 | 206/317 |
| 4,858,361 | A * | 8/1989 | White | F41A 35/02 | 42/96 |
| 4,860,479 | A * | 8/1989 | Easter | F41A 35/02 | 42/96 |
| 5,048,217 | A * | 9/1991 | Easter | F41A 35/02 | 42/96 |
| 5,139,187 | A * | 8/1992 | Fowler | A41D 13/081 | 2/162 |

(Continued)

*Primary Examiner* — Derrick R Morgan
(74) *Attorney, Agent, or Firm* — Timothy Stevens; Technology Law, PLLC

(57) ABSTRACT

A guard for protecting the scope and action of a hunting rifle or the action of a shotgun. The guard can be folded around the scope and action of the rifle or around the action of the shotgun and is held in place by magnets positioned along opposite edges of the guard. The other edges of the guard are gathered by elastic material so that when the guard is folded around the scope and action of the rifle or around the action of the shotgun, the other edges form a cuff around the pistol grip of the rifle or shotgun and a cuff around the forend of the rifle or shotgun.

14 Claims, 6 Drawing Sheets

(56) References Cited

U.S. PATENT DOCUMENTS 5,961,017 A * 10/1999 Mehler ..... A45C 7/009 224/153
6,085,695 A * 7/2000 Miller ..... A01K 27/006 119/795
6,119,388 A * 9/2000 Jones ..... F41A 35/02 42/96
6,256,922 B1 * 7/2001 Jones ..... F41A 35/02 42/96
6,564,498 B2 * 5/2003 Sawtell ..... A01K 97/08 43/26
6,626,339 B2 * 9/2003 Gates ..... B62J 9/003 150/154
6,774,296 B2 * 8/2004 Aesch ..... G10D 9/00 2/66
6,857,652 B2 * 2/2005 Dougherty ..... B60D 1/605 150/166
7,076,810 B1 * 7/2006 Rossini ..... A01K 55/00 2/171.1
7,360,648 B1 * 4/2008 Blaschke ..... F41C 33/06 206/317
7,559,168 B2 * 7/2009 Wisecup ..... F41A 35/02 150/154
7,926,702 B2 * 4/2011 Childs ..... A45C 11/00 229/87.19
8,061,366 B2 * 11/2011 Britton ..... A45D 8/36 132/200
8,307,577 B2 * 11/2012 Baxter ..... F41A 35/02 206/317
8,327,572 B2 * 12/2012 Boggan ..... F41A 35/02 42/96
9,462,862 B2 * 10/2016 Condon ..... A45C 3/04
9,506,713 B2 * 11/2016 Frazier ..... F41A 35/02
9,897,405 B2 * 2/2018 Rowe ..... F41A 9/36
10,039,357 B2 * 8/2018 Wu ..... A45C 7/0063
2003/0224716 A1 * 12/2003 Manfre-Mooney ..... A45C 1/02 453/63
2006/0191184 A1 * 8/2006 Wisecup ..... F41A 35/02 42/96
2007/0062090 A1 * 3/2007 Brindle ..... F41A 35/02 42/96
2007/0192936 A1 * 8/2007 Haller ..... A41D 15/04 2/207
2008/0110076 A1 * 5/2008 Bennett ..... F41A 35/02 42/96
2011/0041376 A1 * 2/2011 Brensinger ..... F41A 35/02 42/96
2012/0127574 A1 * 5/2012 Quinnan ..... F41G 1/383 359/511
2012/0137566 A1 * 6/2012 Baxter ..... F41A 35/02 42/96
2012/0152095 A1 * 6/2012 Youngman ..... D03D 1/0047 89/36.01
2012/0272561 A1 * 11/2012 Risley ..... F41C 33/06 42/96
2013/0105049 A1 * 5/2013 Ebersole ..... F41B 5/148 150/154
2013/0153450 A1 * 6/2013 Travis ..... F41C 33/06 206/317
2014/0082989 A1 * 3/2014 Canham ..... F41A 29/02 42/95
2015/0285580 A1 * 10/2015 Utech ..... F41A 35/02 42/96
2015/0345888 A1 * 12/2015 Frazier ..... F41A 35/02 42/96
2017/0234651 A1 * 8/2017 Jones ..... F41G 1/383 42/143
2018/0202768 A1 * 7/2018 Bridgman, Jr. ..... F41C 33/06
2018/0306538 A1 * 10/2018 DiSessa ..... F41A 9/60
2019/0086180 A1 * 3/2019 Kummer ..... F41A 35/02
2019/0107369 A1 * 4/2019 Jones ..... F41G 1/383

* cited by examiner

GUN GUARD

The instant application claims priority to U.S. Provisional Patent Application Ser. No. 62/447,342 filed Jan. 17, 2017 and to U.S. patent application Ser. No. 15/732,952 filed Jan. 12, 2018.

BACKGROUND OF THE INVENTION

The instant invention relates generally to hunting accessories and in particular to a protective guard for the action and scope of a rifle or a shotgun. Deer hunters and other big game hunters often purchase very expensive telescope sighted rifles which are vulnerable to bad weather, including rain, snow, mud, moisture on underbrush that the hunter is passing through. These moisture sources are the beginning of corrosion which can mar or even ruin expensive equipment. Even in dry conditions a scoped rifle or a shotgun can be easily damaged by sand, dirt, or even dust. A typical hunting trip can cost as much as $25,000. A rifle with scope can cost $1,500 to $5,000 or more while a shotgun can cost as much. Considering the cost of a hunting trip and the cost of equipment, and the expense that replacing such equipment, means to protect the weapon from moisture and dirt, while enabling the hunter to quickly make the weapon ready to shoot are needed. Currently, scope guards are available but their protection is limited to the scope itself. Zippered gun cases which cover the entire weapon are also in widespread use, but their use can delay a hunter's first shot, completely defeating the purpose of the hunt.

U.S. Pat. No. 4,858,361 discloses a protective cover for a firearm comprising magnets sewn into its lower hems with draw cords sewn into its end hems. In use, the cover of the '361 patent is wrapped around the action portion of a firearm so that the magnets close the lower hems if the cover while the draw cords are drawn and tied so that the ends of the cover more closely engage with the firearm. The draw cords of the '361 are untied and the cover is removed when the hunter is ready to use the firearm.

U.S. Pat. No. 7,559,168 discloses a protective cover for a firearm comprising a cover to be draped around the action portion of a telescoped sighted firearm, the cover comprising an elastic cord defining a scope-covering pouch area. The cover of the '168 patent is draped around the action of the firearm and the elastic cord is pulled and locked in place to enclose the telescope sight in a pouch area of the cover. The cord lock of the '168 patent is released and the cover is removed when the hunter is ready to use the firearm.

The covers disclosed in the above cited '361 and '168 patents were an advance in the art but they are not as easy to use or as quiet to use as desired. A more easily and quietly removable, protective guard for a scoped rifle or a shotgun, to protect the scope as well as the action area of the rifle or shotgun is needed in this art.

SUMMARY OF THE INVENTION

The instant invention is the discovery of a protective guard for a scoped rifle or a shotgun. The guard can be folded around the scope and action of the rifle or around the action of the shotgun and is held in place by magnets positioned along opposite edges of the guard. The other edges of the guard are gathered by elastic material so that when the guard is folded around the scope and action of the rifle or around the action of the shotgun, the other edges form a cuff around the pistol grip of the rifle or shotgun and a cuff around the forend of the rifle or shotgun. The guard can be easily and quietly removed from the rifle or shotgun due to the magnetic closure of the guard around the scope and action of the rifle or the action of the shotgun.

More specifically the instant invention is in one embodiment an article for use with, for example, a rifle, the rifle comprising a stock having a pistol grip portion, an action attached to the stock, a forend attached to the action and a telescope sight attached to the action and/or the forend, the article comprising: a sheet of flexible material comprising first, second, third and fourth edges, the first and second ends being on the opposite sides of the sheet of flexible material, the third and fourth edges being on the opposite sides of the sheet of flexible material and orthogonal to the first and second edges; the third and fourth edges comprising an elastomer so that the third and fourth edges are gathered when the elastomer is relaxed; the first and second edges comprising magnetic elements positioned at or near the ends of the first and second edges so that when the article is folded around the telescope sight and action of the rifle the first and second edges of the article are held together by magnetic attraction of the magnetic elements while the gathered third and fourth edges form a cuff around the pistol grip of the stock and a cuff around the forend. The article of the instant invention can also be used to protect a shotgun.

In another embodiment, the instant invention is a method for covering and uncovering the telescope sight and action of a rifle comprising a stock having a pistol grip portion, an action attached to the stock, a forend attached to the action and a telescope sight attached to the action and/or the forend, the method comprising the steps of: folding the article of the previous paragraph around the telescope sight and action of the rifle so that the first and second edges of the article are held together by magnetic attraction of the magnetic elements while the gathered third and fourth edges form a cuff around the pistol grip of the stock and a cuff around the forend to cover the telescope sight and action of the rifle; and pulling the first and second edges of the article with sufficient force to overcome the magnetic attraction of the magnetic elements to uncover the telescope sight and action of the rifle.

In yet another embodiment, the instant invention is a method for covering and uncovering the action of a shotgun comprising a stock having a pistol grip portion, an action attached to the stock, and a forend attached to the action, the method comprising the steps of: folding the article of the previous paragraph around the action so that the first and second edges of the article are held together by magnetic attraction of the magnetic elements while the gathered third and fourth edges form a cuff around the pistol grip of the stock and a cuff around the forend to cover the action of the shotgun; and pulling the first and second edges of the article with sufficient force to overcome the magnetic attraction of the magnetic elements to uncover the action of the shotgun In another embodiment, the instant invention is the discovery of another protective guard for a scoped rifle or a shotgun. The guard of this embodiment can be folded around the scope and action of the rifle or around the action of the shotgun and held in place by magnets positioned along opposite edges of the guard. The other edges of the guard are gathered by draw cords so that when the guard is folded around the scope and action of the rifle or around the action of the shotgun, the draw cords can be adjusted for a specific firearm to form a cuff around the pistol grip of the rifle or shotgun and a cuff around the forend of the rifle or shotgun. The guard of the instant invention can be easily and quietly removed from the rifle or shotgun without attending to the draw cords due to the magnetic closure of the guard around the scope and action of the rifle or the action of the shotgun.

More specifically the instant invention is in another embodiment an article for use with a rifle, the rifle comprising a stock having a pistol grip portion, an action attached to the stock, a forend attached to the action and a telescope sight attached to the action and/or the forend, the article comprising: a sheet of flexible material comprising first, second, third and fourth edges, the first and second ends being on the opposite sides of the sheet of flexible material, the third and fourth edges being on the opposite sides of the sheet of flexible material and orthogonal to the first and second edges; the third and fourth edges comprising a draw cord extending from a midsection of the first and second edges so that the third and fourth edges are gathered when draw cord is pulled from and fixed near said midsection of the first and second edges; the first and second edges comprising magnetic elements positioned at or near the ends of the first and second edges so that when the article is folded around the telescope sight and action of the rifle the first and second edges of the article are held together by magnetic attraction of the magnetic elements while the gathered third and fourth edges form a cuff around the pistol grip of the stock and a cuff around the forend. The article of the instant invention can also be used to protect a shotgun. Since the draw cords emerge from a midsection of the cuffs, there is no need to attend to the draw cords when the article of the instant invention is removed from the rifle or shotgun.

In another embodiment, the instant invention is a method for covering and uncovering the telescope sight and action of a rifle comprising a stock having a pistol grip portion, an action attached to the stock, a forend attached to the action and a telescope sight attached to the action and/or the forend, the method comprising the steps of: folding the article of the previous paragraph around the telescope sight and action of the rifle so that the first and second edges of the article are held together by magnetic attraction of the magnetic elements while the gathered third and fourth edges form a cuff around the pistol grip of the stock and a cuff around the forend to cover the telescope sight and action of the rifle; and pulling the first and second edges of the article with sufficient force to overcome the magnetic attraction of the magnetic elements to uncover the telescope sight and action of the rifle.

In yet another embodiment, the instant invention is a method for covering and uncovering the action of a shotgun comprising a stock having a pistol grip portion, an action attached to the stock, and a forend attached to the action, the method comprising the steps of: folding the article of the previous invention around the action so that the first and second edges of the article are held together by magnetic attraction of the magnetic elements while the gathered third and fourth edges form a cuff around the pistol grip of the stock and a cuff around the forend to cover the action of the shotgun; and pulling the first and second edges of the article with sufficient force to overcome the magnetic attraction of the magnetic elements to uncover the action of the shotgun.

DETAILED DESCRIPTION OF THE INVENTION

Figure 1:
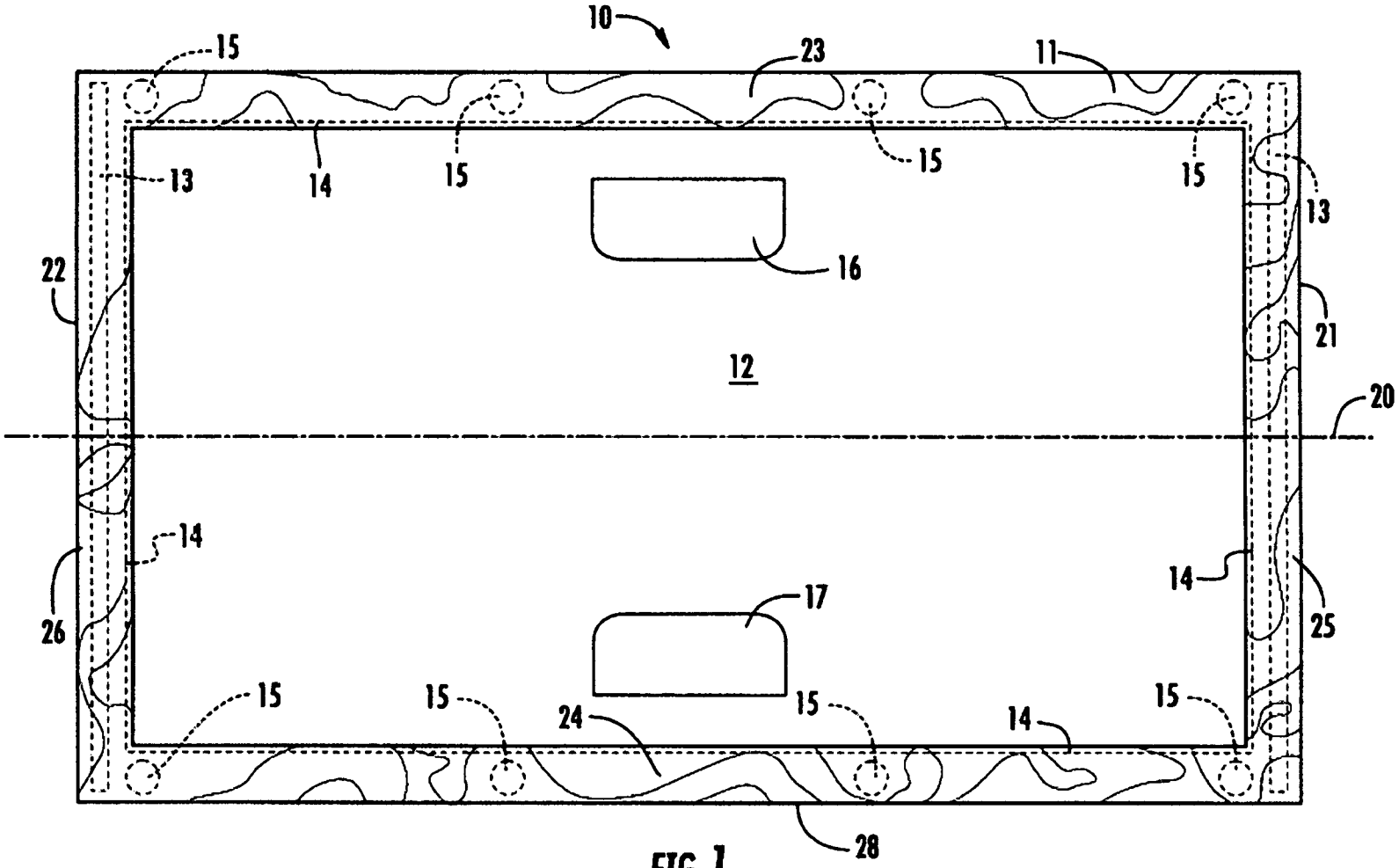
FIG. 1 is a top view of a highly preferred article of the instant invention comprised of a sheet of camouflage patterned fabric sewn to a sheet of hunter orange fabric with side hems containing magnets and end hems containing elastic cord shown extended so that the article lays flat.

Referring now to FIG. 1, therein is shown a highly preferred article 10 for use with a rifle or a shotgun. Article 10 is comprised of a first sheet 11 of a camouflage pattern rip stop woven nylon fabric sewn to second sheet 12 of hunter orange rip stop nylon fabric by stitching 14 to form hem 23 in first side 27, hem 24 in second side 28, hem 25 in third side 21 and hem 26 in fourth side 22 of article 10. Coin shaped neodymium magnets 15 are sewn into hems 23 and 24. Elastic cord 13 (shown extended) is sewn into hems 25 and 26. Napped rubber grip panels 16 and 17 are applied to sheet 12.

Figure 2:
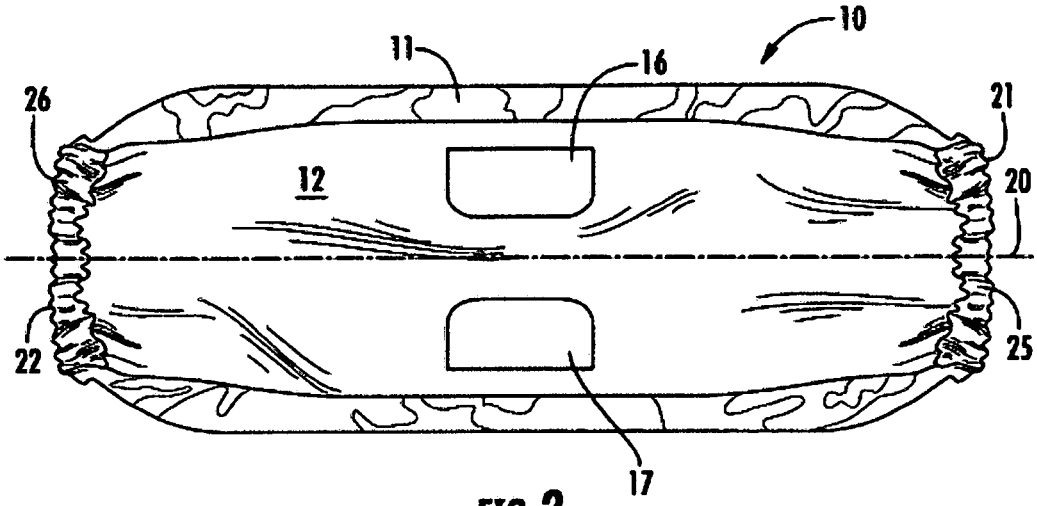
FIG. 2 is a top view of the article of FIG. 1 with the elastic cord of the end hems relaxed to gather the ends of the article.
Figure 3:
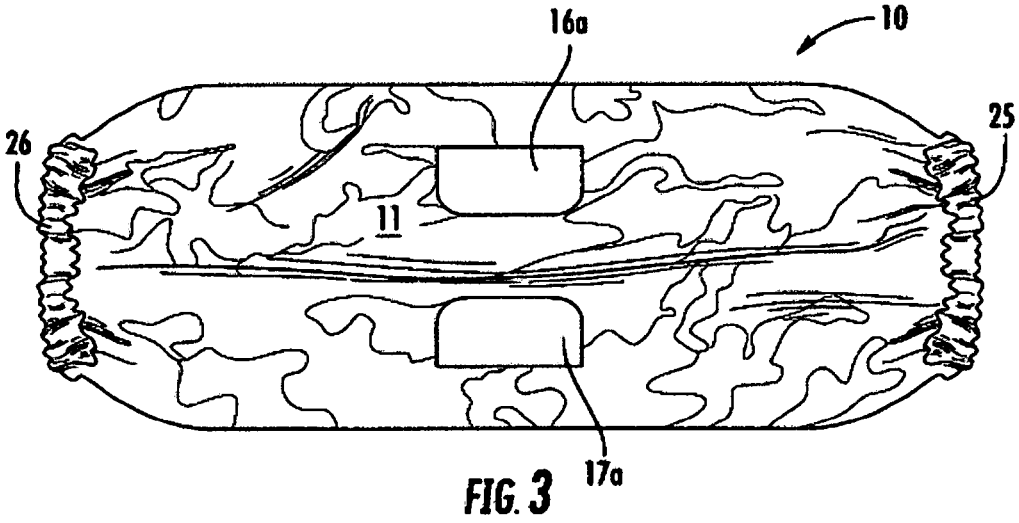
FIG. 3 is a top view of the article of FIG. 2 turned over to show camouflaged side of the article.

Referring now to FIG. 2, therein is shown article 10 shown in FIG. 1 with the elastic cord sewn into hems 25 and 26 relaxed to gather the ends 21 and 22 of article 10. Referring now to FIG. 3, therein is shown the other side of article 10 shown in FIG. 2. Napped rubber grip panels 16*a* and 17*a* are applied to sheet 11.

Figure 4:
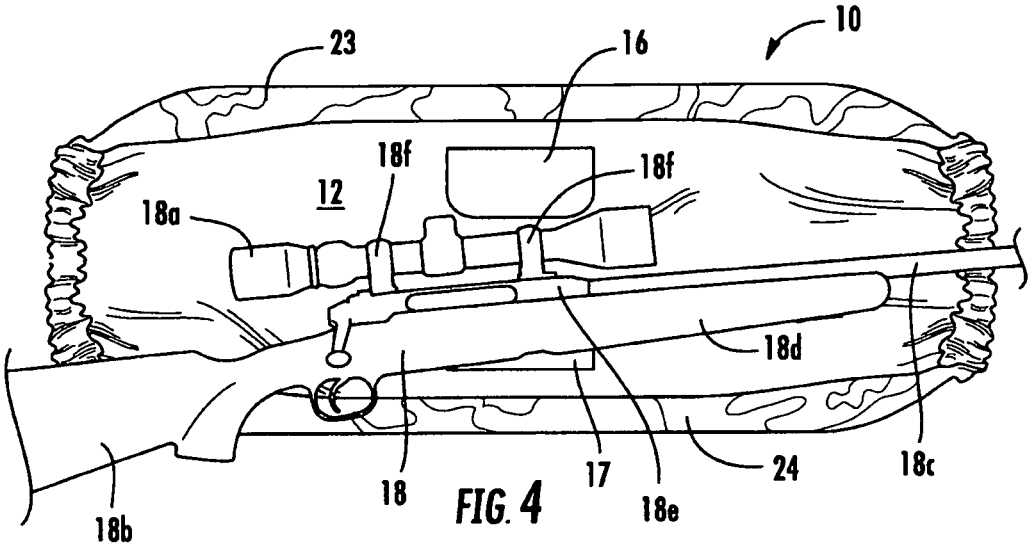
FIG. 4 is a top view of the central portion of a scoped rifle laid on the article of FIG. 3.
Figure 5:
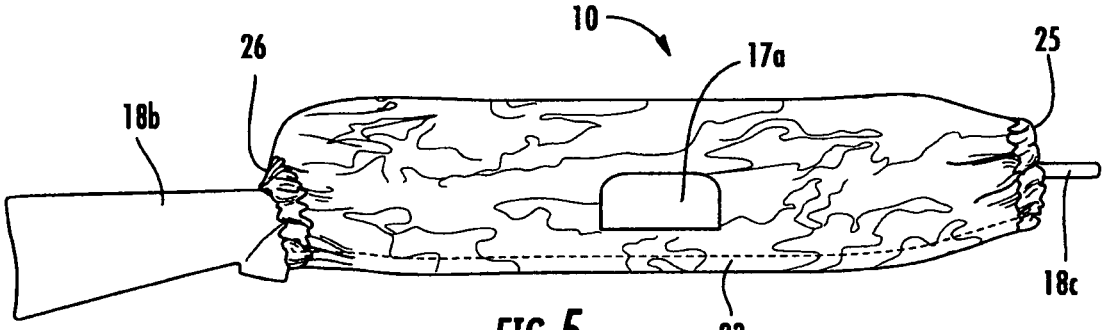
FIG. 5 is a top view of the article of FIG. 4 after it has been folded over to cover the central portion of the scoped rifle.
Figure 6:
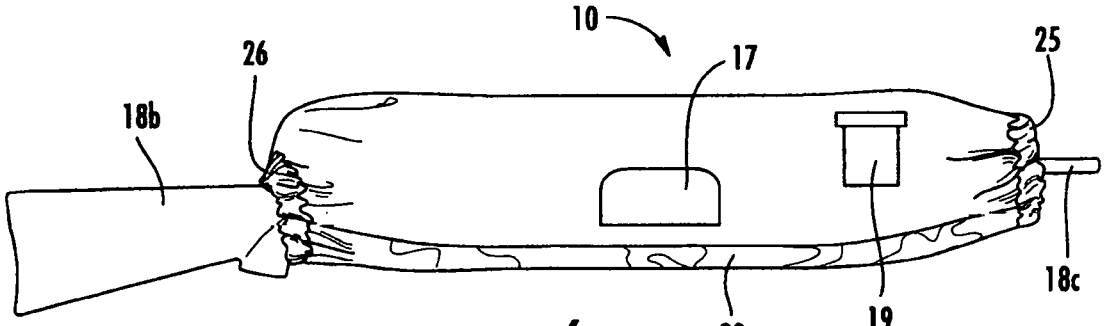
FIG. 6 is a top view of the article of FIG. 3 after it has been folded over to cover the central portion of a scoped rifle

Referring now to FIG. 4, therein is shown rifle 18 placed on article 10 as shown in FIG. 2. Rifle 18 comprises stock 18*d* having a pistol grip portion 18*b*, action 18*e* attached to stock 18*d*, forend 18*e* attached to action 18*e* and telescope sight 18*a* attached to action 18*e* by rings 18*f*. Referring now to FIG. 5, therein is shown article 10 folded around rifle 18 shown in FIG. 4 folded along fold line 20 shown in FIGS. 1 and 2 so that the magnets sewn into hem 23 are magnetically attracted to the magnets sewn into hem 24. Gathered hem 26 forms a cuff around pistol grip stock 18*b*. Gathered hem 25 forms a cuff around forend 18*c*. Article 10 is quickly and quietly removed from rifle 18 by pulling hem 23 to release the magnets sewn into hem 23 and hem 24. Referring now to FIG. 6, therein is shown article 10 as shown in FIG. 3 folded around rifle 18 so that sheet 12 comprised of hunter orange is exposed. Pocket 19 is preferably attached to sheet 12 for containing information such as wind deflection and bullet drop data. Although not shown, sheet 11 can also be provided with such a pocket. It should be understood that any number of such pockets can be attached to one or both sides of the guard of the instant invention and that such pockets can have a clear window so that information contained in a pocket can be read through the window.

Figure 7:
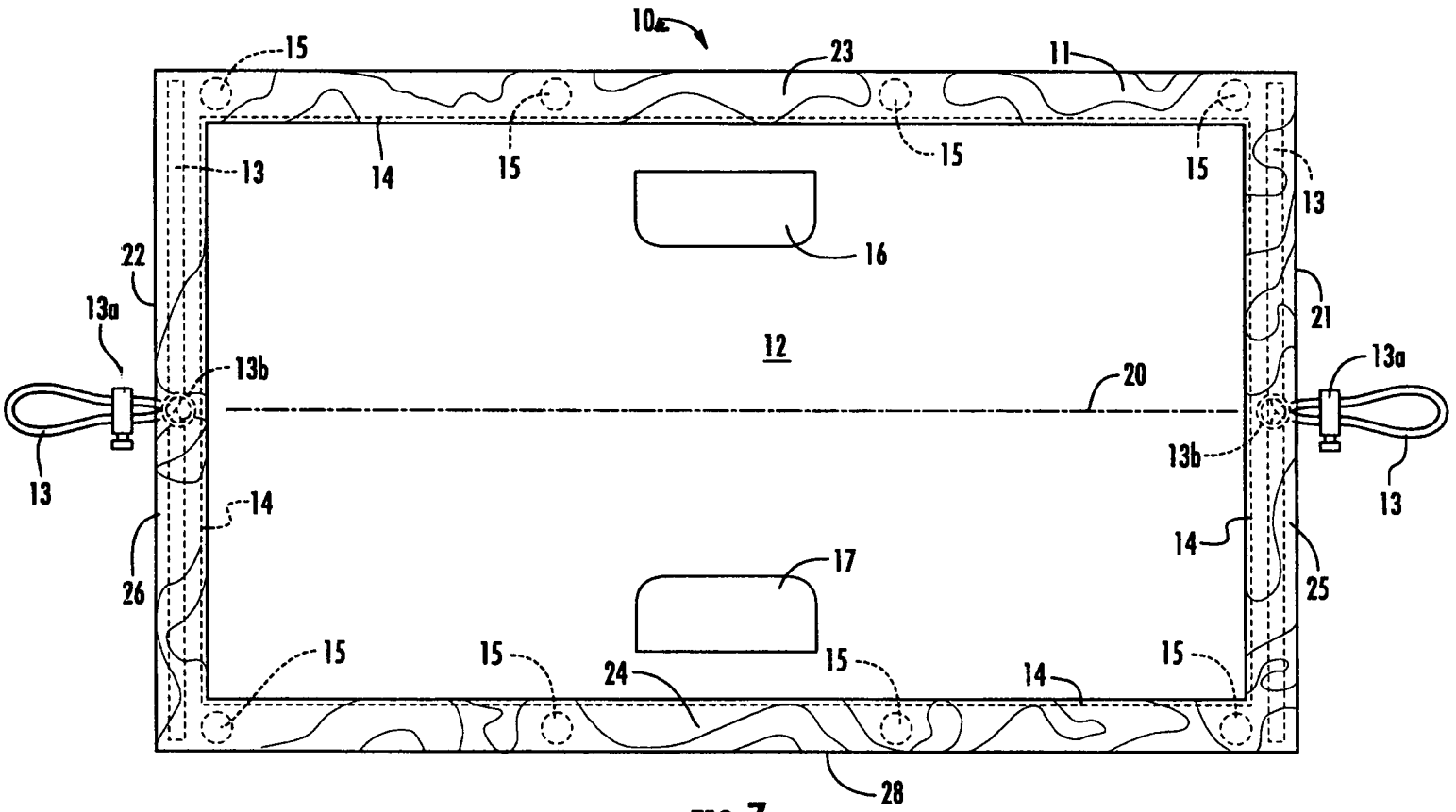
FIG. 7 is a top view of another highly preferred article of the instant invention comprised of a sheet of camouflage patterned fabric sewn to a sheet of hunter orange fabric with side hems containing magnets and end hems containing a draw cord shown in an undrawn state so that the article lays flat.

Referring now to FIG. 7, therein is shown another highly preferred article 10*a* for use with a rifle or a shotgun similar to the article 10 depicted in FIG. 1. Article 10*a* is comprised of a first sheet 11 of a camouflage pattern rip stop woven nylon fabric sewn to second sheet 12 of hunter orange rip stop nylon fabric by stitching 14 to form hem 23 in first side 27, hem 24 in second side 28, hem 25 in third side 21 and hem 26 in fourth side 22 of article 10*a*. Coin shaped neodymium magnets 15 are sewn into hems 23 and 24. Draw cord 13 is sewn into hems 25 and 26 emerging from grommet 13*b* and looped through cord lock 13*a*. The distal ends of cord 13 are sewn to hems 25 and 26. Napped rubber grip panels 16 and 17 are applied to sheet 12.

Figure 8:
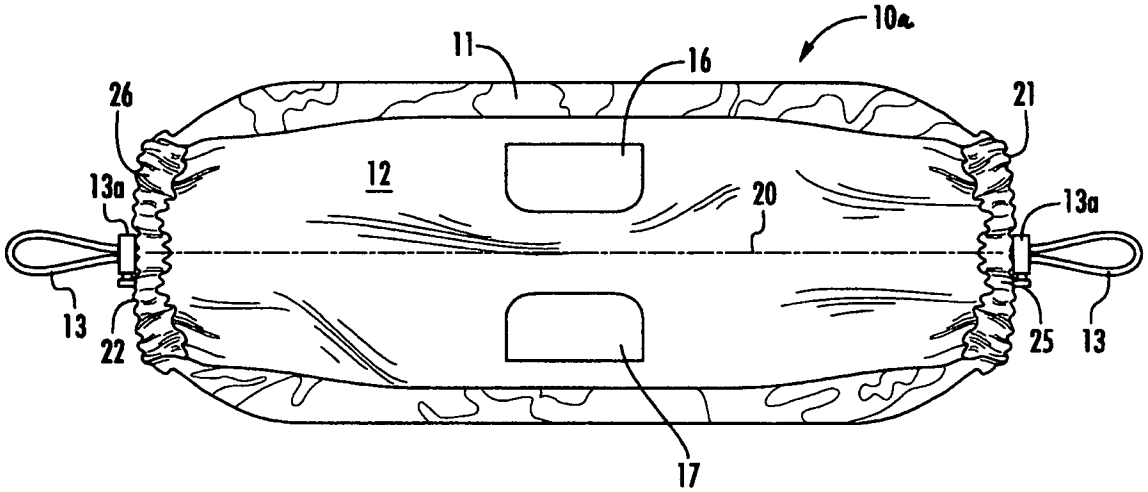
FIG. 8 is a top view of the article of FIG. 7 with the draw cords of the end hems pulled and fixed by a cord lock to gather the ends of the article.

Referring now to FIG. 8, therein is shown article 10*a* shown in FIG. 7 with draw cord 13 sewn into hems 25 and 26 drawn and fixed by cord locks 13*b* to gather the ends 21 and 22 of article 10*a*. Referring now to FIG. 8, therein is shown the other side of article 10*a* shown in FIG. 8. Napped rubber grip panels 16*a* and 17*a* are applied to sheet 11.

Figure 9:
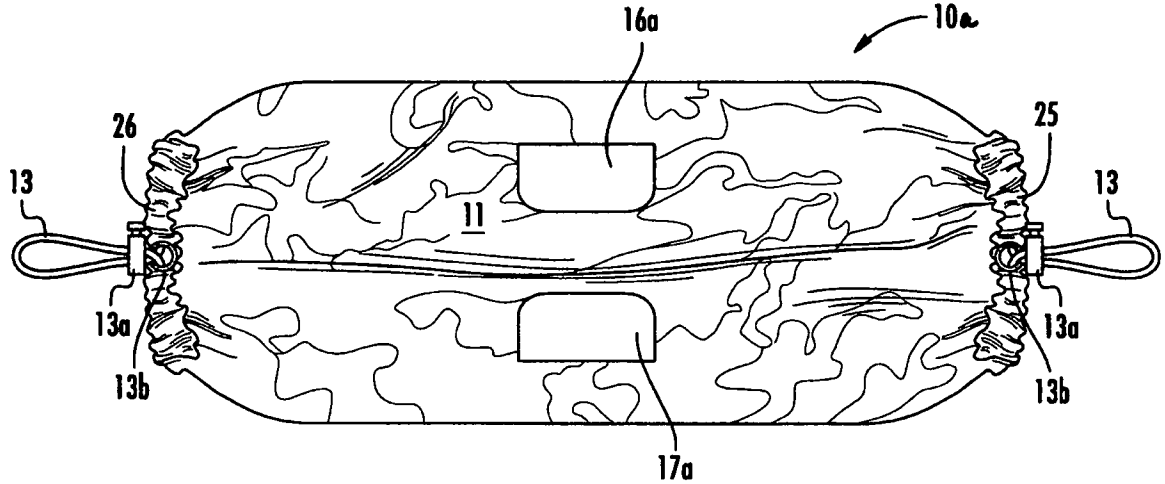
FIG. 9 is a top view of the article of FIG. 8 turned over to show camouflaged side of the article.
Figure 10:
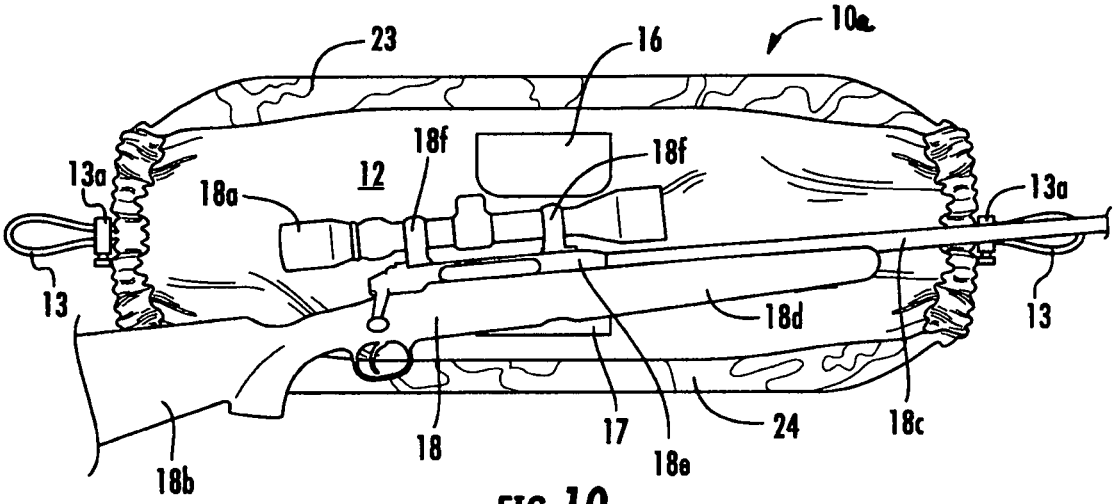
FIG. 10 is a top view of the central portion of a scoped rifle laid on the article of FIG. 9.
Figure 11:
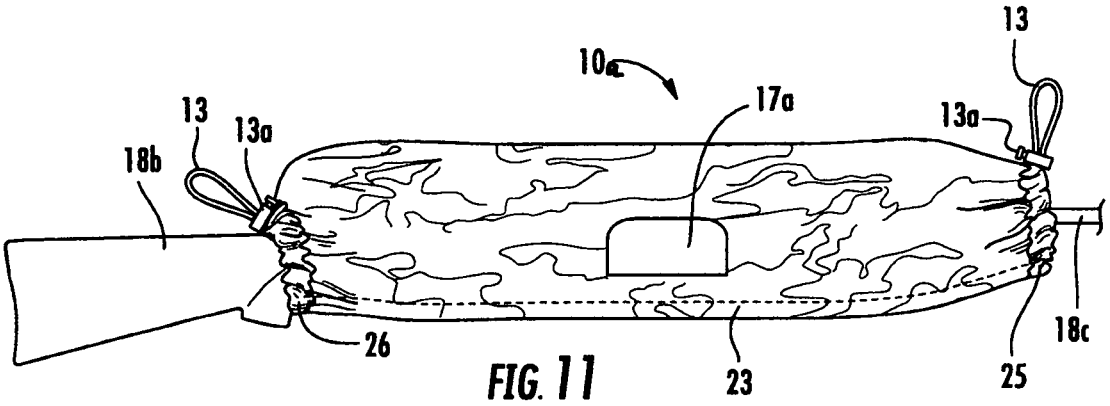
FIG. 11 is a top view of the article of FIG. 10 after it has been folded over to cover the central portion of the scoped rifle.
Figure 12:
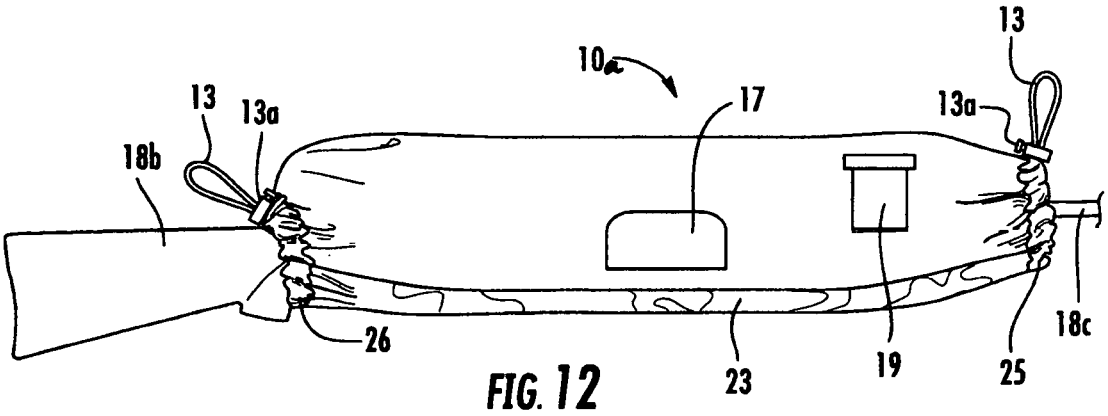
FIG. 12 is a top view of the article of FIG. 9 after it has been folded over to cover the central portion of a scoped rifle.

Referring now to FIG. 10, therein is shown rifle 18 placed on article 10*a* as shown in FIG. 8. Rifle 18 comprises stock 18*d* having a pistol grip portion 18*b*, action 18*e* attached to stock 18*d*, forend 18*e* attached to action 18*e* and telescope sight 18*a* attached to action 18*e* by rings 18*f*. Referring now to FIG. 11, therein is shown article 10*a* folded around rifle 18 shown in FIG. 10*a* folded along fold line 20 shown in FIGS. 7 and 8 so that the magnets sewn into hem 23 are magnetically attracted to the magnets sewn into hem 24. Gathered hem 26 forms a cuff around pistol grip stock 18*b*. Gathered hem 25 forms a cuff around forend 18*c*. Article 10*a* is quickly and quietly removed from rifle 18 by pulling hem 23 to release the magnets sewn into hem 23 and hem 24. Referring now to FIG. 12, therein is shown article 10*a* as shown in FIG. 9 folded around rifle 18 so that sheet 12 comprised of hunter orange is exposed. Pocket 19 is preferably attached to sheet 12 for containing information such as wind deflection and bullet drop data. Although not shown, sheet 11 can also be provided with such a pocket. It should be understood that any number of such pockets can be attached to one or both sides of the guard of the instant invention and that such pockets can have a clear window so that information contained in a pocket can be read through the window. The cuff around the pistol grip of the rifle or shotgun and a cuff around the forend of the rifle or shotgun is preferably initially adjusted for a specific rifle or shotgun when setting out for hunting with the rifle or shotgun so that the article of the instant invention can be silently removed and reapplied to that specific rifle or shotgun, the cuffs having been custom fitted for that specific rifle or shotgun.

The components of the instant invention can be made of any suitable material. For example, a sheet of GORTEX brand waterproof material (or similar waterproof material) can be used between the sheets 11 and 12 of article 10 and 10*a* shown in FIGS. 1 and 7. Although article 10 and 10*a* shown in FIGS. 1 and 7 comprises two sheets of fabric sewn together so that one side has a camouflage pattern while the other side shows hunter orange, it should be understood that a single sheet of flexible material can be used. The napped rubber grips 16, 16*a*, 17 and 17*a* are optional but preferred to provide a better grip on a rifle or shotgun protected by the article of the instant invention. Although article 10 and 10*a* shown in FIGS. 1 and 7 uses magnets in hem 23 and in hem 24 it should be understood that the magnets in hem 23 or in hem 24 can optionally correspond with a ferromagnetic material such as steel. Although article 10 and 10*a* shown in FIGS. 1 and 7 uses two magnets in the center portion of hems 23 and 24, it should be understood that one or three or four or five or more magnets can be used in the instant invention. The sheet or sheets of flexible material used in the instant invention can be any suitable material such as a woven or nonwoven synthetic material such as expanded polytetrafluoroethylene (ePTFE) or any natural material such as cotton or wool. Although article 10 shown in FIG. 1 uses elastic cord 13, any suitable elastic material can be used in the instant invention. Cord 13 shown in FIGS. 7-12 can be, without limitation thereto, an elastic cord. Although cord 13 shown in FIGS. 7-12 is shown as a looped cord, it should be understood that cord 13 can be separate cord lengths fixed by, for example and without limitation thereto, a knot tied near grommet 13*b*.

CONCLUSION

While the instant invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. An article for use with a firearm, the firearm comprising a stock having a pistol grip portion, an action attached to the stock, a forend attached to the action and a telescope sight attached to the action and/or the forend, the article comprising: a sheet of flexible material comprising first, second, third and fourth edges, the first and second edges being on the opposite sides of the sheet of flexible material, the third and fourth edges being on the opposite sides of the sheet of flexible material and orthogonal to the first and second edges; the third and fourth edges comprising a draw cord extending from a midsection of the third and fourth edges so that the third and fourth edges are gathered when draw cord is pulled from a location near said midsection of the third and fourth edges; the first and second edges comprising magnetic elements positioned at or near the ends of the first and second edges so that when the article is folded around the telescope sight and action of the firearm the first and second edges of the article are held together by magnetic attraction of the magnetic elements while the gathered third and fourth edges form a cuff around the pistol grip of the stock and a cuff around the forend with the draw cord extending from a midsection of the third and fourth edges positioned away from the first and second edges.

2. The article of claim 1 wherein the magnetic elements of the first and second edges comprise corresponding permanent magnets.

3. The article of claim 1 wherein the magnetic elements of the first and second edges comprise a permanent magnet matched with a ferromagnetic material.

4. The article of claim 2 further comprising another sheet of flexible material the edge of which is sewn to the sheet of flexible material to form a hem along the first, second, third and fourth edges of the sheet of flexible material, the draw cord of the third and fourth edges being contained in the hems along the third and fourth edges, the magnetic elements of the first and second edges being contained in the hems along the first and second edges.

5. The article of claim 3 further comprising another sheet of flexible material the edge of which is sewn to the sheet of flexible material to form a hem along the first, second, third and fourth edges of the sheet of flexible material, the draw cord of the third and fourth edges being contained in the hems along the third and fourth edges, the magnetic elements of the first and second edges being contained in the hems along the first and second edges.

6. The article of claim 4, wherein one sheet of flexible material is colored hunter orange while the other sheet of flexible material comprises a camouflage pattern.

7. The article of claim 5, wherein one sheet of flexible material is colored hunter orange while the other sheet of flexible material comprises a camouflage pattern.

8. The article of claim 4, further comprising additional magnetic elements contained in the middle sections of the hems along the first and second edges.

9. The article of claim 4, further comprising additional magnetic elements contained in the middle sections of the hems along the first and second edges.

10. The article of claim 5, wherein the draw cord is held in its pulled condition near said midsection of the third and fourth edges by a knot tied in the draw cord near said midsection of the third and fourth edges.

11. The article of claim 5, wherein the draw cord is held in its pulled condition near said midsection of the third and fourth edges by a cord lock engaging with the draw cord positioned near said midsection of the third and fourth edges.

12. The article of claim 10, wherein the draw cord is an elastic draw cord.

13. The article of claim 11, wherein the draw cord is an elastic draw cord.

14. A method for covering and uncovering the telescope sight and action of a firearm comprising a stock having a pistol grip portion, an action attached to the stock, a forend attached to the action and a telescope sight attached to the action and/or the forend, the method comprising the steps of: folding the article of claim 1 around the telescope sight and action of the firearm so that the first and second edges of the article are held together by magnetic attraction of the magnetic elements; pulling the draw cords from the midsection of the third and fourth edges to gather the third and fourth edges to form a cuff around the pistol grip of the stock and a cuff around the forend to cover the telescope sight and action of the firearm; and pulling the first and second edges of the article with sufficient force to overcome the magnetic attraction of the magnetic elements to uncover the telescope sight and action of the firearm without the need to attend to the draw cords.

* * * * *